US011228090B2

(12) United States Patent
Lin et al.

(10) Patent No.: US 11,228,090 B2
(45) Date of Patent: Jan. 18, 2022

(54) ANTENNA STRUCTURE AND WIRELESS COMMUNICATION DEVICE USING SAME

(71) Applicant: Chiun Mai Communication Systems, Inc., New Taipei (TW)

(72) Inventors: Jung-Chin Lin, New Taipei (TW); Yen-Hui Lin, New Taipei (TW); Yi-Chieh Lee, New Taipei (TW); Geng-Hong Liou, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 192 days.

(21) Appl. No.: 16/234,614

(22) Filed: Dec. 28, 2018

(65) Prior Publication Data

US 2019/0214704 A1 Jul. 11, 2019

(30) Foreign Application Priority Data

Dec. 28, 2017 (CN) ..... 201711464095.2

(51) Int. Cl.

| | |
|---|---|
| ***H01Q 1/22*** | (2006.01) |
| ***H01Q 5/15*** | (2015.01) |
| ***H01Q 5/307*** | (2015.01) |
| ***H01Q 5/371*** | (2015.01) |
| ***H01Q 9/42*** | (2006.01) |

(52) U.S. Cl.

CPC ..... *H01Q 1/2291* (2013.01); *H01Q 5/15* (2015.01); *H01Q 5/307* (2015.01); *H01Q 5/371* (2015.01); *H01Q 9/42* (2013.01)

(58) Field of Classification Search

CPC ..... H01Q 1/2291; H01Q 1/38; H01Q 1/50; H01Q 5/15; H01Q 5/307; H01Q 5/357; H01Q 5/364; H01Q 5/371; H01Q 9/42

See application file for complete search history.

(56) References Cited

U.S. PATENT DOCUMENTS

| | | | | |
|---|---|---|---|---|
| 6,961,028 | B2 | 11/2005 | Joy et al. | |
| 8,013,800 | B2 | 9/2011 | Zheng et al. | |
| 8,798,554 | B2 | 8/2014 | Darnell et al. | |
| 9,362,621 | B1 * | 6/2016 | He | H01Q 5/10 |
| 2007/0030198 | A1 * | 2/2007 | Wei | H01Q 9/42 343/700 MS |
| 2009/0073048 | A1 | 3/2009 | Kim | |
| 2011/0254738 | A1 * | 10/2011 | Chiu | H01Q 1/2266 343/700 MS |
| 2014/0354497 | A1 * | 12/2014 | Chen | H01Q 9/42 343/770 |

(Continued)

FOREIGN PATENT DOCUMENTS

| | | |
|---|---|---|
| CN | 202134653 U | 2/2012 |
| CN | 204118251 U | 1/2015 |

(Continued)

*Primary Examiner* — Robert Karacsony

(74) *Attorney, Agent, or Firm* — ScienBiziP, P.C.

(57) ABSTRACT

An antenna structure for an Access Point includes at least one connecting member and a plurality of radiating portions on a structural rear plate of the Access Point which from. The radiating portions form a plurality of resonance paths. The at least one connecting member feeds current into the plurality of radiating portions, each of the radiating portions generates radiation signals in a first frequency band. A wireless communication device using the antenna structure is also provided.

19 Claims, 10 Drawing Sheets

200

(56) References Cited

U.S. PATENT DOCUMENTS

| | | | |
|---|---|---|---|
| 2015/0109171 | A1 | 4/2015 | Lin |
| 2015/0318601 | A1 | 11/2015 | Lin |
| 2017/0201022 | A1 | 7/2017 | Ko |

FOREIGN PATENT DOCUMENTS

| | | | |
|---|---|---|---|
| CN | 105024160 | A | 11/2015 |
| CN | 205376750 | U | 7/2016 |
| TW | 201521276 | A | 6/2015 |

* cited by examiner

ANTENNA STRUCTURE AND WIRELESS COMMUNICATION DEVICE USING SAME

FIELD

The subject matter herein generally relates to an antenna structure and a wireless communication device using the antenna structure.

BACKGROUND

Wireless LAN Access Points (APs) are widely used for wireless communication. A housing of the AP includes a backside for being mounted to a wall. However, the backside of the AP normally does not need to transmit wireless signals. Thus, the backside of the AP may also be used as an extension for an antenna of the AP to achieve a better radiating efficiency and a forward radiation characteristic of the antenna. Therefore, a transmission of the AP can be optimized by an improvement to the art.

BRIEF DESCRIPTION OF THE DRAWINGS

Implementations of the present disclosure will now be described, by way of example only, with reference to the attached figures.

DETAILED DESCRIPTION

Figure 1:
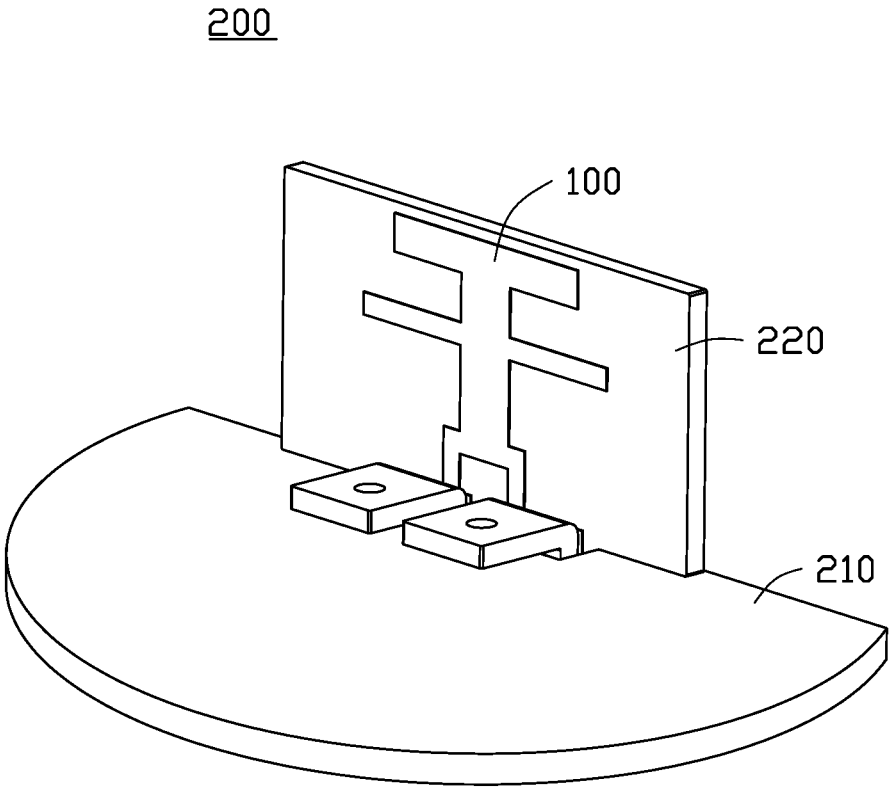
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using the antenna structure.

FIG. 1 illustrates an exemplary embodiment of a wireless communication device 200 using a first exemplary antenna structure 100. The wireless communication device 200 can be a wireless LAN access point (AP), for example, which can receive or send wireless signals.

The wireless communication device 200 includes the antenna structure 100, a main circuit board 210, and a secondary circuit board 220. The antenna structure 100 is arranged on the secondary circuit board 220. The secondary circuit board 220 is perpendicularly coupled to the main circuit board 210. The main circuit board 210 includes a plurality of electronic elements, such as a processor, a storage device, and a radio-frequency signals circuit, for executing wireless communication functions.

Figure 2:
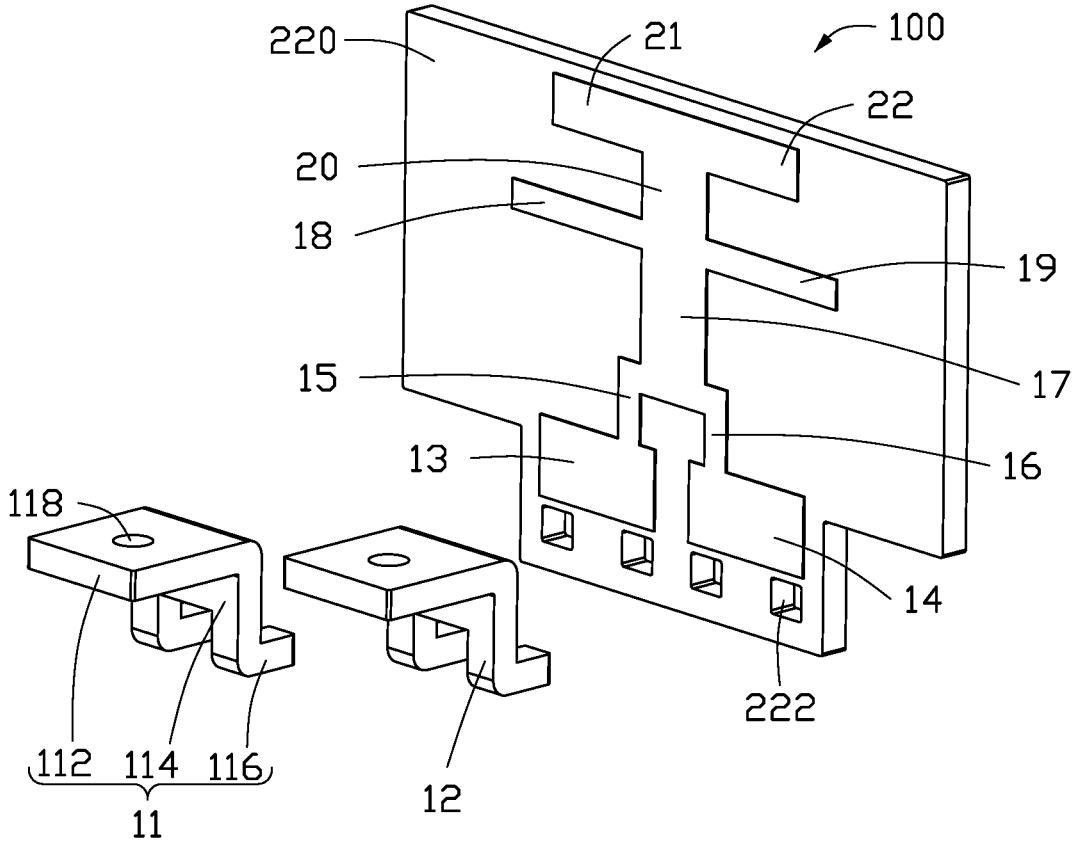
FIG. 2 is an exploded view of a first embodiment of the antenna structure of FIG. 1.

FIG. 2 shows the secondary circuit board 220 defines a plurality of openings 222 at one end. In at least one embodiment, the plurality of openings 222 are spaced from each other and arranged substantially symmetrical on either side of a vertical line through the midpoint of the antenna structure 100.

The antenna structure 100 includes a first connecting member 11, a second connecting member 12, a first radiating portion 13, a second radiating portion 14, a third radiating portion 15, a fourth radiating portion 16, a fifth radiating portion 17, a sixth radiating portion 18, a seventh radiating portion 19, an eighth radiating portion 20, a ninth radiating portion 21, and a tenth radiating portion 22.

The first connecting member 11 and the second connecting member 12 have substantially a same structure. In this exemplary embodiment, the first connecting member 11 is presented in detail, the second connecting member 12 should be known according to the first connecting member 11. The first connecting member 11 includes a mounting portion 112, a resisting portion 114, and an engaging portion 116. Opposite ends of the resisting portion 114 are perpendicularly received in the mounting portion 112 and the engaging portion 116. The mounting portion 112 defines a mounting hole 118. The mounting portion 112 can be mounted to the main circuit portion 210 by inserting a securing piece, such as a screw, through the mounting hole 118. The engaging portion 116 includes two L-shaped arms, each of the L-shaped arms extends from the resisting portion 114 and then bent through ninety degrees. A bending direction of the engaging portion 116 is opposite to the mounting portion 112. The engaging portion 116 in inserted into the openings 222, thus to couple the first connecting member 11 and the second connecting member 12 to the secondary circuit board 220. In at least one embodiment, a quantity of the openings 222 is four, a quantity of the L-shaped arms of the engaging portion 116 of the first connecting member 11 and the second connecting member 12 is four. The resisting portions 114 of the first connecting member 11 and the second connecting member 12 resist against the first radiating portion 13 and the second radiating portion 14, and thus establish electrical connections. In at least one embodiment, the first connecting member 11 is electrically connected to a feed source of the main circuit board 210 for feeding current into the antenna structure 100. The second connecting member 12 is grounded and provides a ground connection for the antenna structure 100.

The first radiating portion 13 and the second radiating portion 14 are both substantially a rectangular metal sheet and are spaced from each other. The first radiating portion 13 and the second radiating portion 14 are adjacent to the openings 222. The third radiating portion 15 and the fourth radiating portion 16 are both of metal arms. An end of the third radiating portion 15 is perpendicularly connected to the first radiating portion 13, an end of the fourth radiating portion 16 is perpendicularly connected to the second radiating portion 14. The fifth radiating portion 17 is substantially a rectangular metal sheet. An end of the fifth radiating portion 17 is connected between ends of the third radiating portion 15 and the fourth radiating portion 16 is away from the first radiating portion 13 and the second radiating portion 14. The fifth radiating portion 17, the third radiating portion 15, and the fourth radiating portion 16 extend in a same direction. The sixth radiating portion 18 and the seventh radiating portion 19 are both substantially metal arms. An end of the fifth radiating portion 17 away from the third radiating portion 15 and the fourth radiating portion 16 is perpendicularly connected between the sixth radiating portion 18 and the seventh radiating portion 19. The sixth radiating portion 18 and the seventh radiating portion 19 are collinear and extend in opposite directions. The eighth radiating portion 20 is substantially a rectangular metal sheet. An end of the eighth radiating portion 20 is connected to an end of the fifth radiating portion 17 that connects the sixth radiating portion 18 and the seventh radiating portion 19. The eighth radiating portion 20 and the fifth radiating portion 17 are collinear and extend in a same direction. The ninth radiating portion 21 and the tenth radiating portion 22 are both substantially metal arms. An end of the eighth radiating portion 20 away from the sixth radiating portion 18 and the seventh radiating portion 19 is perpendicularly connected between the ninth radiating portion 21 and the tenth radiating portion 22. The ninth radiating portion 21 and the tenth radiating portion 22 are collinear and extend in opposite directions.

The first radiating portion 13 and the second radiating portion 14 have a same size. The third radiating portion 15 and the fourth radiating portion 16 have a same size. The sixth radiating portion 18 and the seventh radiating portion 19 have a same size. The ninth radiating portion 21 and the tenth radiating portion 22 have a same size, hence all the radiating portions are substantially symmetrical around the vertical midpoint line through the antenna structure 100. A length of each of the sixth radiating portion 18 and the seventh radiating portion 19 is greater than a length of each of the ninth radiating portion 21 and the tenth radiating portion 22. A width of each of the sixth radiating portion 18 and the seventh radiating portion 19 is smaller than a width of each of the ninth radiating portion 21 and the tenth radiating portion 22.

Figure 3:
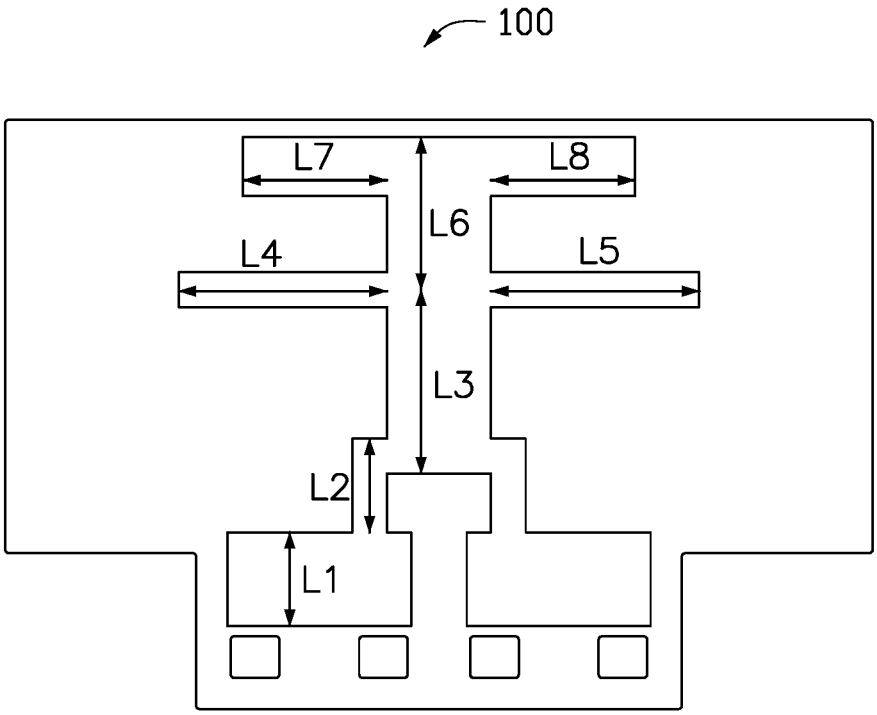
FIG. 3 is a planar view of the first embodiment of the antenna structure of FIG. 2.

In FIG. 3, a width of the first radiating portion 13 is L1, that is, a width from a side of the first radiating portion 13 that is adjacent to the openings 222 to another side of the first radiating portion 13 that connects the third radiating portion 15 is L1. A length of the third radiating portion 15 is L2. A length of the fifth radiating portion 17 is L3. A length of the sixth radiating portion 18 is L4. A length of the seventh radiating portion 19 is L5. A length of the eighth radiating portion 20 is L6. A length of the ninth radiating portion 21 is L7. A length of the tenth radiating portion 22 is L8.

The first connecting member 11 feeds current into the first radiating portion 13 from the feed source of the main circuit board 210. The first radiating portion 13, the third radiating portion 15, the fifth radiating portion 17, and the sixth radiating portion 18 cooperatively form a first resonance path, a total length L1+L2+L3+L4 of the first resonance path being 20 millimeters. The first radiating portion 13, the third radiating portion 15, the fifth radiating portion 17, and the seventh radiating portion 19 cooperatively form a second resonance path, a total length L1+L2+L3+L5 of the second resonance path being 20 millimeters. The first radiating portion 13, the third radiating portion 15, the fifth radiating portion 17, the eighth radiating portion 20, and the ninth radiating portion 21 cooperatively form a third resonance path, a total length L1+L2+L3+L6+L7 of the third resonance path being 20 millimeters. The first radiating portion 13, the third radiating portion 15, the fifth radiating portion 17, the eighth radiating portion 20, and the tenth radiating portion 22 cooperatively form a fourth resonance path, a total length L1+L2+L3+L6+L8 of the fourth resonance path being 20 millimeters. All the resonance paths are grounded through the second connecting member 12. In at least one embodiment, the respective lengths of the first resonance path, the second resonance path, the third resonance path, and the fourth resonance path are the same, each of the resonance paths can activate a first mode to generate radiation signals in a first frequency band. In this exemplary embodiment, the first mode is a WI-FI 2.4G operation mode, while the first frequency band is a frequency band of about 2400-2484 MHz. Additionally, a frequency doubling of the WI-FI 2.4G operation mode can activate a second mode to generate radiation signals in a second frequency band. In this exemplary embodiment, the second mode is a WI-FI 5G operation mode, while the second frequency band is a frequency band of about 5200-5800 MHz.

Figure 4:
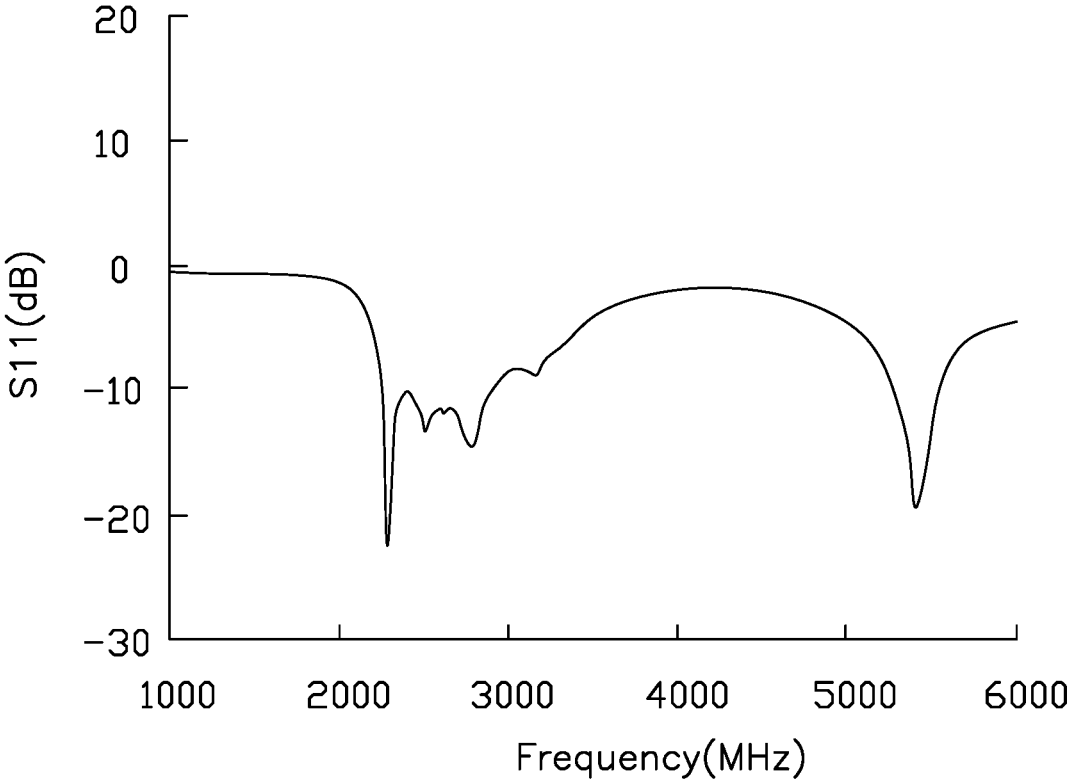
FIG. 4 is a return loss (RL) graph of the first embodiment when the antenna structure of FIG. 2 in operating.

FIG. 4 illustrates a return loss (RL) graph of the antenna structure 100 in operation. When the antenna structure 100 operates at the WI-FI 2.4G frequency band of 2400-2484 MHz and the WI-FI 5G frequency band of 5200-5800 MHz a working frequency satisfies a design of the antenna and also has a good radiating efficiency.

Figure 5:
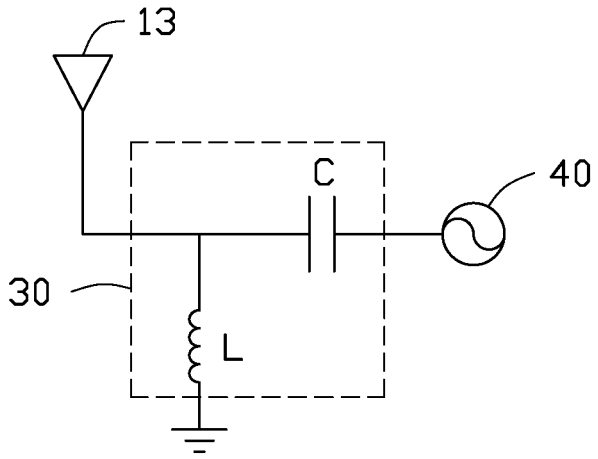
FIG. 5 is a circuit diagram of a first embodiment of a matching circuit of the antenna structure.

Referring to FIG. 5, the antenna structure 100 further includes a first matching circuit 30. The first matching circuit 30 is arranged on the secondary circuit board 220. The first matching circuit 30 includes a capacitor C and an inductor L. The capacitor C is electrically connected between a feed source 40 and the first radiating portion 13. An end of the inductor L is electrically connected between the radiating portion 13 and the capacitor C, another end is electrically connected to ground. In at least one embodiment, an inductance of the inductor L is 3 nanohenry (nH), a capacity of the capacitor C is 1.5 picofarad (pF).

In at least one embodiment, when the antenna structure 100 includes the first matching circuit 30, in the WI-FI 2.4G frequency band of 2400-2484 MHz, a radiating efficiency of the antenna structure 100 is −1.8 dB; in the WI-FI 5G frequency band of 5200-5800 MHz, a radiating efficiency of the antenna structure 100 is −2.8 dB.

In conclusion, when the first matching circuit 30 is included in the antenna structure 100, the antenna structure 100 at the WI-FI 2.4G frequency band and the WI-FI 5G frequency band, a working frequency satisfies a design of the antenna and also has a good radiating efficiency.

Figure 6:
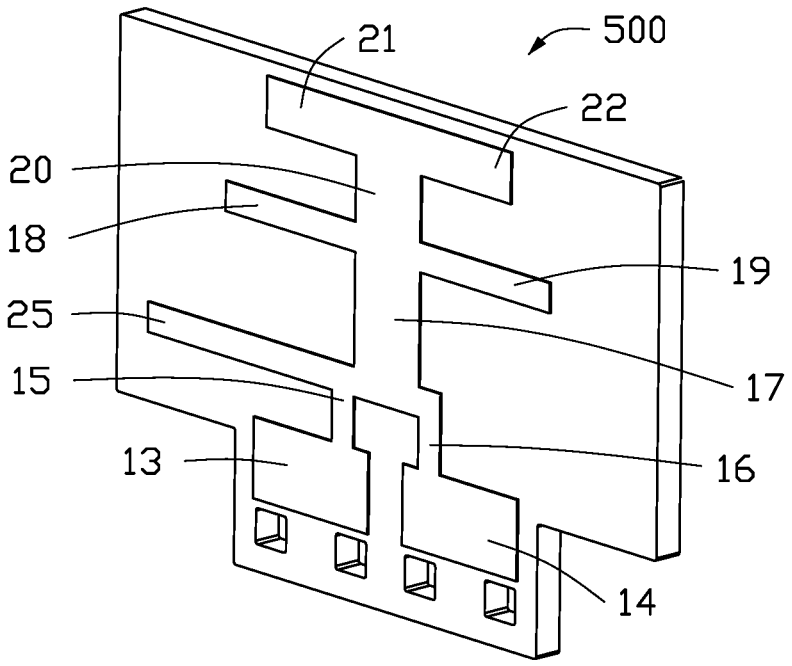
FIG. 6 is an exploded view of a second embodiment of the antenna structure.

FIG. 6 illustrates a second embodiment of an antenna structure 500. The antenna structure 500 has a similar structure with the antenna structure 100 of the first embodiment, except that the antenna structure 500 further includes an extending portion 25. The extending portion 25 renders the antenna structure 500 non-symmetrical. An end of the extending portion 25 is perpendicularly connected to the end of the third radiating portion 15 that connects to the fifth radiating portion 17. The extending portion 25, the first radiating portion 13, the sixth radiating portion 18, and the ninth radiating portion 21 are in parallel. A length of the extending portion 25 is greater than the length of the sixth radiating portion 18. The extending portion 25 may activate the second mode to generate radiation signals in the second frequency band. The antenna structure 500 further includes a second matching circuit, which is structurally similar to the first matching circuit 30. However, a capacity of a capacitor C and an inductance of an inductor L in the second matching circuit of the second embodiment are different from those of the capacitor C and the inductor L in the first matching circuit 30 of the first embodiment. In detail, the capacity of the capacitor C is 2.2 picofarad, the inductance of the inductor L is 3.6 nanohenry in the second matching circuit.

Figure 7:
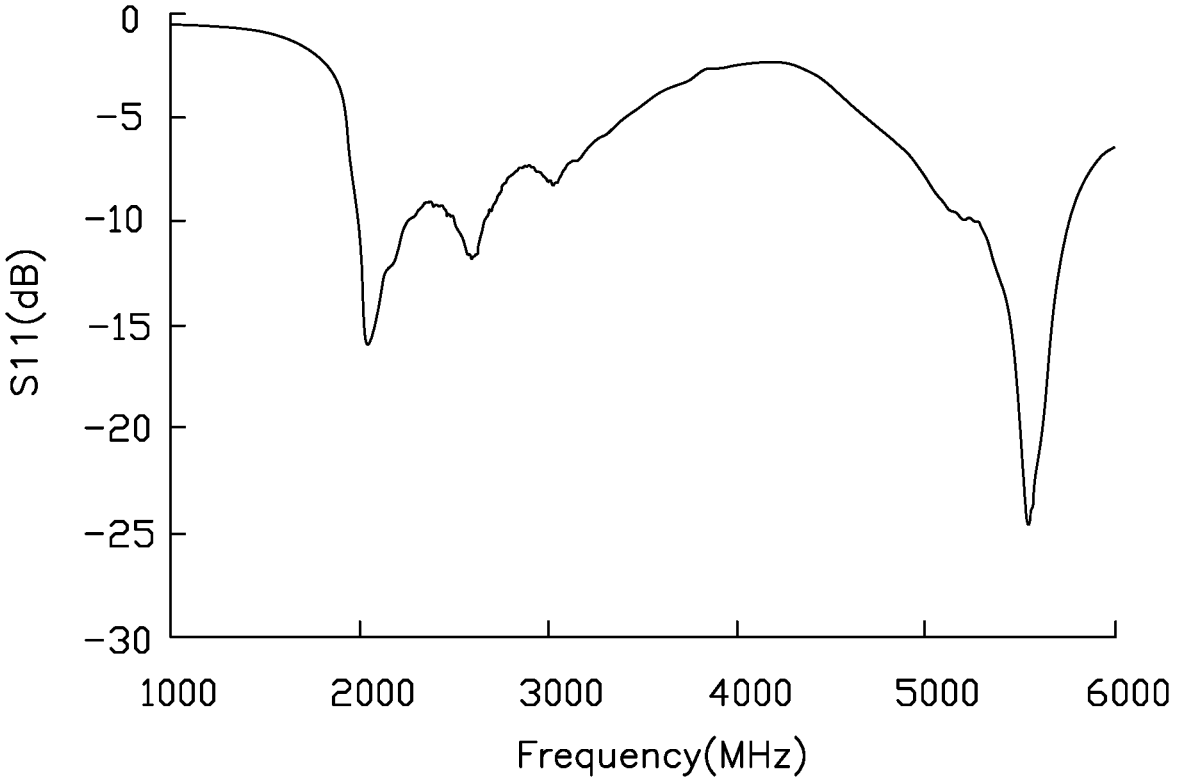
FIG. 7 is a return loss (RL) graph of a second embodiment when the antenna structure of FIG. 6 is in operating.

FIG. 7 illustrates a return loss (RL) graph of the antenna structure 500 in operation. When the antenna structure 500 operates at the WI-FI 2.4G frequency band of 2400-2484 MHz and the WI-FI 5G frequency band of 5200-5800 MHz a working frequency satisfies a design of the antenna and also has a good radiating efficiency. In the second embodiment, when the antenna structure 500 includes the second matching circuit, in the WI-FI 2.4G frequency band of 2400-2484 MHz, a radiating efficiency of the antenna structure 500 is −1.8 dB; in the WI-FI 5G frequency band of 5200-5800 MHz, a radiating efficiency of the antenna structure 500 is −2.1 dB. The addition of the extending portion 25 improves the radiating efficiency of the antenna structure 500 in the WI-FI 5G frequency band.

Figure 8:
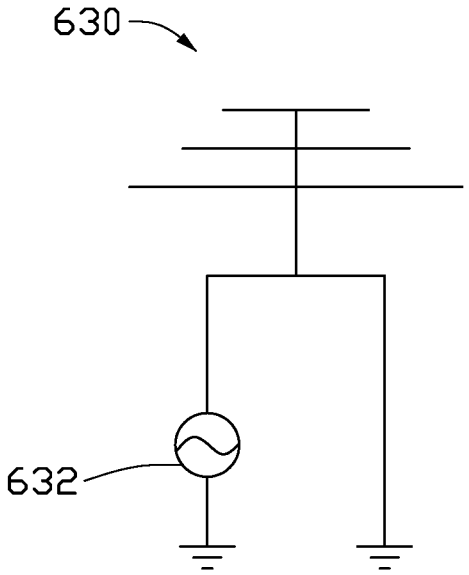
FIGS. 8-13 are views of third to eighth embodiments of the antenna structure.
Figure 9:
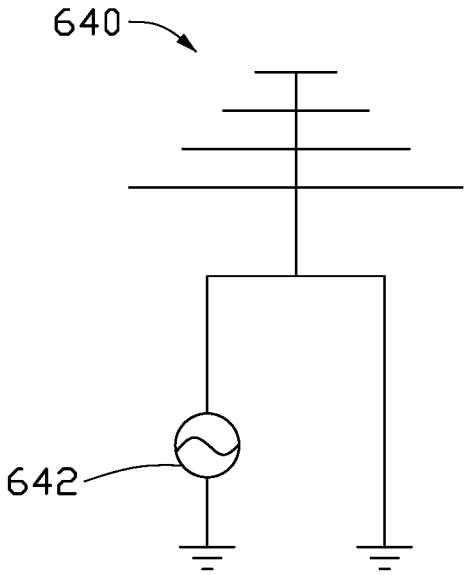

FIGS. 8 and 9 illustrate a third embodiment, being an antenna structure 630, and a fourth embodiment, being antenna structure 640. The antenna structures 630, 640 have a similar structure with the antenna structure 100 of the first embodiment, except that the antenna structures 630, 640 have more resonance paths. In detail, the antenna structure 630 of the third embodiment shown in FIG. 8 includes six resonance paths in a same length. The antenna structure 640 of the fourth embodiment shown in FIG. 9 includes eight resonance paths in a same length. The plurality of resonance paths of the antenna structure 630 of the third embodiment share a feed source 632 and a ground connection, and the plurality of resonance paths of the antenna structure 640 of the fourth embodiment share a feed source 642 and a ground connection. Each of the resonance paths of the antenna structures 630, 640 forms a PIFA antenna.

Figure 10:
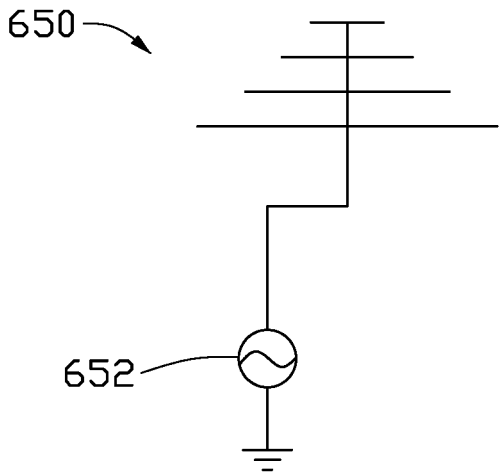
Figure 11:
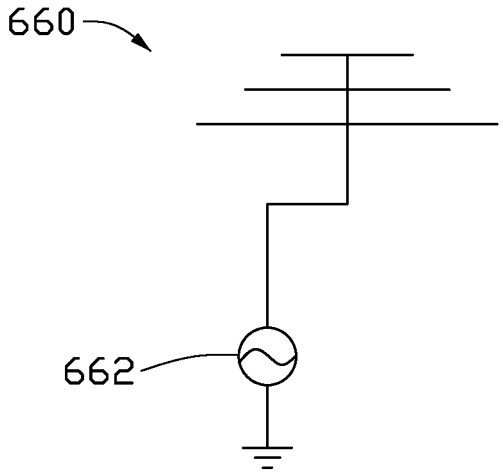
Figure 12:
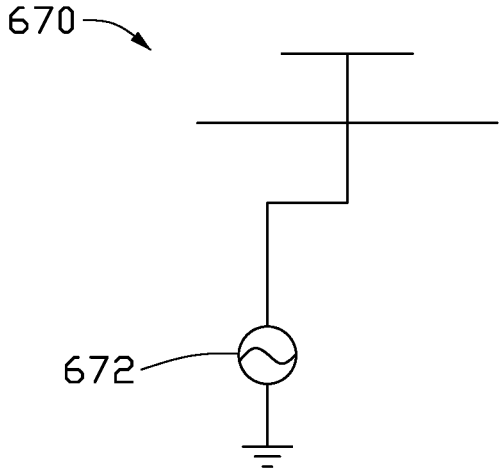

FIGS. 10, 11, and 12 show a fifth embodiment, showing an antenna structure 650, and a sixth embodiment, showing an antenna structure 660, and a seventh embodiment, being an antenna structure 670. The antenna structures 650, 660, 670 have a similar structure with the antenna structure 100 of the first embodiment, except that the antenna structures 650, 660, 670 are monopole antennas and each have more resonance paths. That is, the detail of the antenna structure 650 of the fifth embodiment shown in FIG. 10 includes eight resonance paths in a same length. The antenna structure 660 of the sixth embodiment shown in FIG. 11 includes six resonance paths in a same length. The antenna structure 670 of the seventh embodiment shown in FIG. 12 includes four resonance paths in a same length. The plurality of resonance paths of the antenna structure 650 of the fifth embodiment share a feed source 652 and a ground, the plurality of resonance paths of the antenna structure 660 of the sixth embodiment share a feed source 662 and a ground, and the plurality of resonance paths of the antenna structure 670 of the seventh embodiment share a feed source 672 and a ground. Each of the resonance paths of the antenna structure 650, 660, 660 forms a monopole antenna.

Figure 13:
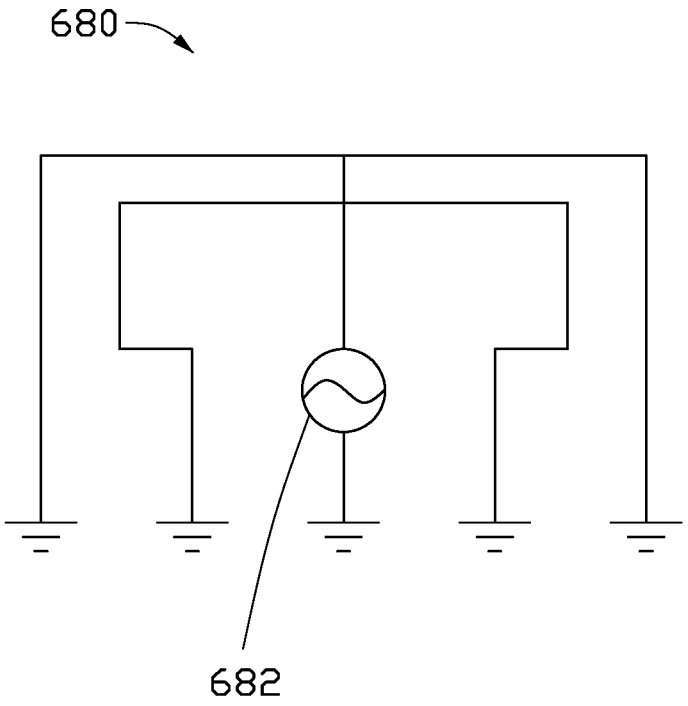

FIG. 13 illustrates an eighth embodiment of an antenna structure 680 being a loop antenna and having four resonance paths in a same length. The plurality of resonance paths of the antenna structure 680 of the eighth embodiment shown in FIG. 13 share a feed source 652 and electrically connect to ground at the ends of each resonance path. Each antenna structure 680 forms a loop antenna having resonance paths.

The wireless communication device 200 includes the antenna structure 100, 500 mounted on the secondary circuit board 220, each of the antenna structure 100, 500 includes a plurality of resonance paths, which improving an extension for the antenna and obtaining a greater radiating efficiency and a forward radiating characteristic. Therefore, radiating performance of the Wireless LAN Access Point is improved.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

at least one connecting member; and a plurality of radiating portions forming a plurality of resonance paths;

wherein the at least one connecting member feeds current into the plurality of radiating portions, each of the plurality of resonance paths has a same length, and generates radiation signals in a first frequency band;

wherein the antenna structure comprises a first radiating portion, a second radiating portion, a third radiating portion, a fourth radiating portion, a fifth radiating portion, a sixth radiating portion, a seventh radiating portion, an eighth radiating portion, a ninth radiating portion, and a tenth radiating portion; the first radiating portion and the second radiating portion are both rectangular metal sheets and are spaced from each other; the third radiating portion and the fourth radiating portion are both of metal arms; an end of the third radiating portion is perpendicularly connected to the first radiating portion, an end of the fourth radiating portion is perpendicularly connected to the second radiating portion;

wherein the fifth radiating portion is a rectangular metal sheet an end of the fifth radiating portion is connected between ends of the third radiating portion and the fourth radiating portion away from the first radiating portion and the second radiating portion; the fifth radiating portion, the third radiating portion, and the fourth radiating portion extend in a same direction; the sixth radiating portion and the seventh radiating portion are both metal arms; an end of the fifth radiating portion away from the third radiating portion and the fourth radiating portion is perpendicularly connected between the sixth radiating portion and the seventh radiating portion; the sixth radiating portion and the seventh radiating portion are collinear and extend in opposite directions;

wherein the eighth radiating portion is rectangular a metal sheet an end of the eighth radiating portion is connected to an end of the fifth radiating portion that connect the sixth radiating portion and the seventh radiating portion; the eighth radiating portion and the fifth radiating portion are collinear and extend in a same direction; the ninth radiating portion and the tenth radiating portion are both substantially metal arms; an end of the eighth radiating portion away from the sixth radiating portion and the seventh radiating portion is perpendicularly connected between the ninth radiating portion and the tenth radiating portion; the ninth radiating portion and the tenth radiating portion are collinear and extend in opposite directions;

wherein the first radiating portion, the third radiating portion, the fifth radiating portion, and the sixth radiating portion cooperatively form a first resonance path; the first radiating portion, the third radiating portion, the fifth radiating portion, and the seventh radiating portion cooperatively form a second resonance path; the first radiating portion, the third radiating portion, the fifth radiating portion, the eighth radiating portion, and the ninth radiating portion cooperatively form a third resonance path; the first radiating portion, the third radiating portion, the fifth radiating portion, the eighth radiating portion, and the tenth radiating portion cooperatively form a fourth resonance path; the first resonance path, the second resonance path, the third resonance path, and the fourth resonance path have a same length; each of the resonance paths activates a first mode to generate radiation signals in the first frequency band and a second mode to generate radiation signals in a second frequency band.

2. The antenna structure of claim 1, wherein each of the plurality of resonance paths further generates radiation signals in a second frequency band, the second frequency band is multiple frequency of the first frequency band.

3. The antenna structure of claim 1, wherein the first mode is a WI-FI 2.4G operation mode, while the first frequency band is a frequency band of about 2400-2484 MHz, the second mode is a WI-FI 5G operation mode, while the second frequency band is a frequency band of about 5200-5800 MHz.

4. The antenna structure of claim 3, wherein the antenna structure further comprises an extending portion, an end of the extending portion is perpendicularly connected to the end of the third radiating portion that connecting the fifth radiating portion; the extending portion, the first radiating portion, the sixth radiating portion, and the ninth radiating portion are in parallel; a length of the extending portion is greater than the length of the sixth radiating portion; the extending portion activates the second mode to generate radiation signals in the second frequency band.

5. The antenna structure of claim 1, wherein the antenna structure further comprises a matching circuit, the first matching circuit includes a capacitor and an inductor; the capacitor is electrically connected between a feed source and the first radiating portion; an end of the inductor is electrically connected between the first radiating portion and the capacitor, another end is electrically connected to the ground.

6. The antenna structure of claim 1, wherein the antenna structure further comprises a first connecting member and a second connecting member having a same structure, each of the first connecting member and the second connecting member includes a mounting portion, a resisting portion, and an engaging portion; opposite ends of the resisting portion are perpendicularly received in the mounting portion and the engaging portion; the mounting portion defines a mounting hole; the engaging portion includes two L-shaped arms, each of the L-shaped arms extends from the resisting portion and then bent through ninety degrees; a bending direction of the engaging portion is opposite to the mounting portion; the resisting portions of the first connecting member and the second connecting member resist against the first radiating portion and the second radiating portion, and the first connecting member is electrically connected to a feed source for feeding current into the antenna structure; the second connecting member is grounded and provides a ground connection for the antenna structure; the first resonance path, the second resonance path, the third resonance path, and the fourth resonance path are grounded through the second connecting member.

7. The antenna structure of claim 1, wherein the plurality of resonance paths share a feed source and a ground, each of the resonance paths forms a PIFA antenna.

8. The antenna structure of claim 1, wherein the plurality of resonance paths share a feed source, each of the resonance paths forms a monopole antenna.

9. The antenna structure of claim 1, wherein the plurality of resonance paths share a feed source, each of the resonance paths electrically connects to a ground by at an end, each of the resonance paths forms a loop antenna.

10. A wireless communication device, comprising:

an antenna structure, the antenna structure comprising:

at least one connecting member; and a plurality of radiating portions forming a plurality of resonance paths;

wherein the at least one connecting member feeds current into the plurality of radiating portions, each of the plurality of resonance paths has a same length, and generates radiation signals in a first frequency band wherein the antenna structure comprises a first radiating portion, a second radiating portion, a third radiating portion, a fourth radiating portion, a fifth radiating portion, a sixth radiating portion, a seventh radiating portion, an eighth radiating portion, a ninth radiating portion, and a tenth radiating portion; the first radiating portion and the second radiating portion are both rectangular metal sheets and are spaced from each other; the third radiating portion and the fourth radiating portion are both of metal arms; an end of the third radiating portion is perpendicularly connected to the first radiating portion, an end of the fourth radiating portion is perpendicularly connected to the second radiating portion;

wherein the fifth radiating portion is a rectangular metal sheet; an end of the fifth radiating portion is connected between ends of the third radiating portion and the fourth radiating portion away from the first radiating portion and the second radiating portion; the fifth radiating portion, the third radiating portion, and the fourth radiating portion extend in a same direction; the sixth radiating portion and the seventh radiating portion are both metal arms; an end of the fifth radiating portion away from the third radiating portion and the fourth radiating portion is perpendicularly connected between the sixth radiating portion and the seventh radiating portion; the sixth radiating portion and the seventh radiating portion are collinear and extend in opposite directions;

wherein the eighth radiating portion is rectangular a metal sheet an end of the eighth radiating portion is connected to an end of the fifth radiating portion that connect the sixth radiating portion and the seventh radiating portion; the eighth radiating portion and the fifth radiating portion are collinear and extend in a same direction; the ninth radiating portion and the tenth radiating portion are both substantially metal arms; an end of the eighth radiating portion away from the sixth radiating portion and the seventh radiating portion is perpendicularly connected between the ninth radiating portion and the tenth radiating portion; the ninth radiating portion and the tenth radiating portion are collinear and extend in opposite directions;

wherein the first radiating portion, the third radiating portion, the fifth radiating portion, and the sixth radiating portion cooperatively form a first resonance path; the first radiating portion, the third radiating portion, the fifth radiating portion, and the seventh radiating portion cooperatively form a second resonance path; the first radiating portion, the third radiating portion, the fifth radiating portion, the eighth radiating portion, and the ninth radiating portion cooperatively form a third resonance path; the first radiating portion, the third radiating portion, the fifth radiating portion, the eighth radiating portion, and the tenth radiating portion cooperatively form a fourth resonance path; the first resonance path, the second resonance path, the third resonance path, and the fourth resonance path have a same length; each of the resonance paths activates a first mode to generate radiation signals in the first frequency band and a second mode to generate radiation signals in a second frequency band.

11. The wireless communication device as claim 10, further comprising a main circuit board and a secondary circuit board, wherein the secondary circuit board is perpendicularly coupled to the main circuit board, the antenna structure is mounted on the secondary circuit board; the secondary circuit board defines a plurality of openings on an end, the plurality of openings are spaced from each other and arranged so as be substantially symmetrical on either side of a vertical line through the midpoint of the antenna structure.

12. The wireless communication device as claim 11, wherein each of the plurality of resonance paths further generates radiation signals in a second frequency band, the second frequency band is multiple frequency of the first frequency band.

13. The wireless communication device as claim 10, wherein the first mode is a WI-FI 2.4G operation mode, while the first frequency band is a frequency band of about 2400-2484 MHz, the second mode is a WI-FI 5G operation mode, while the second frequency band is a frequency band of about 5200-5800 MHz.

14. The wireless communication device as claim 13, wherein the antenna structure further comprises an extending portion, an end of the extending portion is perpendicularly connected to the end of the third radiating portion that connecting the fifth radiating portion; the extending portion, the first radiating portion, the sixth radiating portion, and the ninth radiating portion are in parallel; a length of the extending portion is greater than the length of the sixth radiating portion; the extending portion activates the second mode to generate radiation signals in the second frequency band.

15. The wireless communication device as claim 10, wherein the antenna structure further comprises a matching circuit, the first matching circuit includes a capacitor and an inductor; the capacitor is electrically connected between a feed source and the first radiating portion; an end of the inductor is electrically connected between the first radiating portion and the capacitor, another end is electrically connected to the ground.

16. The wireless communication device as claim 10, wherein the antenna structure further comprises a first connecting member and a second connecting member having a same structure, each of the first connecting member and the second connecting member includes a mounting portion, a resisting portion, and an engaging portion; opposite ends of the resisting portion are perpendicularly received in the mounting portion and the engaging portion; the mounting portion defines a mounting hole; the engaging portion includes two L-shaped arms, each of the L-shaped arms extends from the resisting portion and then bent through ninety degrees; a bending direction of the engaging portion is opposite to the mounting portion; the resisting portions of the first connecting member and the second connecting member resist against the first radiating portion and the second radiating portion, and the first connecting member is electrically connected to a feed source for feeding current into the antenna structure; the second connecting member is grounded and provides a ground connection for the antenna structure; the first resonance path, the second resonance path, the third resonance path, and the fourth resonance path are grounded through the second connecting member; the engaging portion in inserted into the openings, thus to couple the first connecting member and the second connecting member to the secondary circuit board; the mounting portion is mounted to the main circuit portion by inserting a securing piece through the mounting hole.

17. The wireless communication device as claim 10, wherein the plurality of resonance paths share a feed source and a ground, each of the resonance paths forms a PIFA antenna.

18. The wireless communication device as claim 10, wherein the plurality of resonance paths share a feed source, each of the resonance paths forms a monopole antenna.

19. The wireless communication device as claim 10, wherein the plurality of resonance paths share a feed source, each of the resonance paths electrically connects to a ground by at an end, each of the resonance paths forms a loop antenna.

* * * * *